US009966028B2

(12) United States Patent
Zhang

(10) Patent No.: US 9,966,028 B2
(45) Date of Patent: May 8, 2018

(54) LIQUID CRYSTAL DEVICES AND GATE DRIVING CIRCUITS THEREOF

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 280 days.

(21) Appl. No.: 14/893,903

(22) PCT Filed: Aug. 25, 2015

(86) PCT No.: PCT/CN2015/088022

§ 371 (c)(1),
(2) Date: Nov. 24, 2015

(87) PCT Pub. No.: WO2017/020371

PCT Pub. Date: Feb. 9, 2017

(65) Prior Publication Data

US 2017/0162157 A1 Jun. 8, 2017

(30) Foreign Application Priority Data

Aug. 5, 2015 (CN) ..... 2015 1 0475824

(51) Int. Cl.
*G09G 3/36* (2006.01)

(52) U.S. Cl.
CPC ..... *G09G 3/3677* (2013.01); *G09G 3/3696* (2013.01); *G09G 2300/0871* (2013.01); *G09G 2310/0286* (2013.01); *G09G 2310/08* (2013.01)

(58) Field of Classification Search
None
See application file for complete search history.

(56) References Cited

U.S. PATENT DOCUMENTS

2010/0309191 A1* 12/2010 Hsu ..... G09G 3/3677 345/213
2014/0168044 A1* 6/2014 Hu ..... G09G 3/3696 345/90
2017/0162157 A1* 6/2017 Zhang ..... G09G 3/3677

* cited by examiner

*Primary Examiner* — Ilana Spar
*Assistant Examiner* — Mihir K Rayan
(74) *Attorney, Agent, or Firm* — Andrew C. Cheng

(57) ABSTRACT

A LCD and the gate driving circuit thereof are disclosed. The gate driving circuit includes a shift register circuit and a shift register circuit and a level transition circuit connected with the shift register circuit. The level transition circuit generates clock signals, selection signals, and negative voltage reference signals for the shift register circuit. The clock signals, the selection signals, and the negative voltage reference signals are configured for driving the shift register circuit. A negative voltage value of the negative voltage reference signals (VSS) is larger than the negative voltage value of one of the clock signals or the selection signals. In this way, the TFTs of the shift register circuit own better turn-off capability so as to avoid malfunction.

16 Claims, 5 Drawing Sheets

LIQUID CRYSTAL DEVICES AND GATE DRIVING CIRCUITS THEREOF

BACKGROUND OF THE INVENTION

1. Field of the Invention

The present disclosure relates to liquid crystal display technology, and more particularly to a liquid crystal device (LCD) and the gate driving circuit thereof.

2. Discussion of the Related Art

FIG. 1 is a circuit diagram of one conventional level transition circuit. FIG. 2 is a timing diagram of the clock signals, selection signals, and voltage reference signals of FIG. 1. As shown in FIG. 1, the level transition circuit 10 is configured for generating the clock signals CK1, CK2, the selection signals LC1, LC2, and the voltage reference signals (VSS). The clock signals CK1, CK2, the selection signals LC1, LC2, and the voltage reference signals (VSS) are configured for driving the shift register circuit. The level transition circuit 10 inputs the high voltage VGH and the low voltage VGL. The high voltage of the clock signals CK1, CK2 and the selection signals LC1, LC2 are VGH, and the low voltage of the clock signals CK1, CK2, the selection signals LC1, LC2 and the voltage reference signals (VSS) are VGL. As shown in FIG. 2, when the low voltage of the clock signals CK1, CK2, the selection signals LC1, LC2, and the voltage reference signals (VSS) are VGL, the thin film transistors (TFTs) of the shift register circuit may not be turned off normally.

SUMMARY

The object of the invention is to provide a liquid crystal device and the gate driving circuit thereof for providing better turn-off capability of the TFTs.

In one aspect, a gate driving circuit of LCDs includes: a shift register circuit and a shift register circuit and a level transition circuit connected with the shift register circuit, the level transition circuit generates clock signals, selection signals, and negative voltage reference signals for the shift register circuit, the clock signals, the selection signals, and the negative voltage reference signals are configured for driving the shift register circuit, and a negative voltage value of the negative voltage reference signals (VSS) is larger than the negative voltage value of one of the clock signals or the selection signals; the selection signals and the selection signals are configured for selecting two functional modules within the shift register circuit to operate alternately, the shift register circuit includes a plurality of thin film transistors (TFTs), the clock signals and the selection signals are respectively applied to a gate of the TFT, and the negative voltage reference signals are respectively applied to a corresponding source of the TFT; and the level transition circuit includes at least two input ports for inputting negative voltage input signals, the negative voltage values of the negative voltage input signals inputted by the input ports are different, and the level transition circuit generates the negative voltage reference signals in accordance with a maximum value of the negative voltage values of the negative voltage input signals inputted by the at least two input ports.

Wherein the negative voltage value of the negative voltage reference signals is larger than the negative voltage value of the clock signals or the selection signals.

In another aspect, a gate driving circuit of LCDs includes: a shift register circuit and a shift register circuit and a level transition circuit connected with the shift register circuit, the level transition circuit generates clock signals, selection signals, and negative voltage reference signals for the shift register circuit, the clock signals, the selection signals, and the negative voltage reference signals are configured for driving the shift register circuit, and a negative voltage value of the negative voltage reference signals (VSS) is larger than the negative voltage value of one of the clock signals or the selection signals.

Wherein the negative voltage value of the negative voltage reference signals is larger than the negative voltage values of the clock signals or the selection signals.

Wherein the level transition circuit includes at least two input ports for inputting negative voltage input signals, the negative voltage values of the negative voltage input signals inputted by the input ports are different, and the level transition circuit generates the negative voltage reference signals in accordance with a maximum value of the negative voltage values of the negative voltage input signals inputted by the at least two input ports.

Wherein the level transition circuit includes a first input port, a second input port, a third input port, the first input port, the second input port, and the third input port are configured for respectively inputting the first, the second, and the third negative voltage input signals, the level transition circuit further includes a clock signals generation module, a selection signals generation module, and a generation module of negative voltage reference signals, the clock signals generation module configures the negative voltage value of the clock signals to be proportional to the negative voltage value of the first negative voltage input signals, the selection signals generation module configures the negative voltage values of the selection signals to be proportional to the negative voltage value of the second negative voltage input signals, the generation module of negative voltage reference signals configures the negative voltage value of the negative voltage reference signals to be proportional to the negative voltage value of the third negative voltage input signals when the third input port has the third negative voltage input signals.

Wherein the negative voltage value of the third negative voltage input signals is larger than one of the negative voltage values of the first negative voltage input signals and the second negative voltage input signals.

Wherein the negative voltage value of the third negative voltage input signals is larger than the negative voltage values of the first negative voltage input signals and the second negative voltage input signals.

Wherein the generation module of negative voltage reference signals further configures the negative voltage value of the negative voltage reference signals to be proportional to the maximum value of the negative voltage values of the first negative voltage input signals and the second negative voltage input signals when the third negative voltage input signals are not in the third input port.

Wherein the level transition circuit further includes a fourth input port configured for inputting positive voltage input signals, wherein the clock signals generation module configures a positive voltage value of the clock signals to be proportional to the positive voltage value of the positive voltage input signals, and the selection signals generation module configures the positive voltage values of the selection signals to be proportional to the positive voltage value of the positive voltage input signals.

In another aspect, a liquid crystal device (LCD) includes: a gate driving circuit including a shift register circuit and a shift register circuit and a level transition circuit connected with the shift register circuit, the level transition circuit generates clock signals, selection signals, and negative voltage reference signals for the shift register circuit, the clock signals, the selection signals, and the negative voltage reference signals are configured for driving the shift register circuit, and a negative voltage value of the negative voltage reference signals (VSS) is larger than the negative voltage value of one of the clock signals or the selection signals.

Wherein the negative voltage value of the negative voltage reference signals is larger than the negative voltage value of the clock signals or the selection signals.

Wherein the level transition circuit includes at least two input ports for inputting negative voltage input signals, the negative voltage values of the negative voltage input signals inputted by the input ports are different, and the level transition circuit generates the negative voltage reference signals in accordance with a maximum value of the negative voltage values of the negative voltage input signals inputted by the at least two input ports.

Wherein the level transition circuit includes a first input port, a second input port, a third input port, the first input port, the second input port, and the third input port are configured for respectively inputting the first, the second, and the third negative voltage input signals, the level transition circuit further includes a clock signals generation module, a selection signals generation module, and a generation module of negative voltage reference signals, the clock signals generation module configures the negative voltage value of the clock signals to be proportional to the negative voltage value of the first negative voltage input signals, the selection signals generation module configures the negative voltage values of the selection signals to be proportional to the negative voltage value of the second negative voltage input signals, the generation module of negative voltage reference signals configures the negative voltage value of the negative voltage reference signals to be proportional to the negative voltage value of the third negative voltage input signals when the third input port has the third negative voltage input signals.

Wherein the negative voltage value of the third negative voltage input signals is larger than one of the negative voltage values of the first negative voltage input signals and the second negative voltage input signals.

Wherein the negative voltage value of the third negative voltage input signals is larger than the negative voltage values of the first negative voltage input signals and the second negative voltage input signals.

Wherein the generation module of negative voltage reference signals further configures the negative voltage value of the negative voltage reference signals to be proportional to the maximum value of the negative voltage values of the first negative voltage input signals and the second negative voltage input signals when the third negative voltage input signals are not in the third input port.

Wherein the level transition circuit further includes a fourth input port configured for inputting positive voltage input signals, wherein the clock signals generation module configures a positive voltage value of the clock signals to be proportional to the positive voltage value of the positive voltage input signals, and the selection signals generation module configures the positive voltage values of the selection signals to be proportional to the positive voltage value of the positive voltage input signals.

Wherein the selection signals and the selection signals are configured for selecting two functional modules within the shift register circuit to operate alternately, the shift register circuit includes a plurality of TFTs, the clock signals and the selection signals are respectively applied to a gate of the TFT, and the negative voltage reference signals are respectively applied to a corresponding source of the TFT.

In view of the above, the level transition circuit generates the clock signals, the selection signals and the negative voltage reference signals for the shift register circuit. The clock signals, the selection signals and the negative voltage reference signals are for driving the shift register circuit, wherein the negative voltage reference signals are larger than negative pressure value of the clock signals or the selections signals. In this way, the TFTs of the shift register circuit owns better turn-off capability so as to avoid malfunction.

DETAILED DESCRIPTION OF THE EMBODIMENTS

Embodiments of the invention will now be described more fully hereinafter with reference to the accompanying drawings, in which embodiments of the invention are shown.

Figure 1:
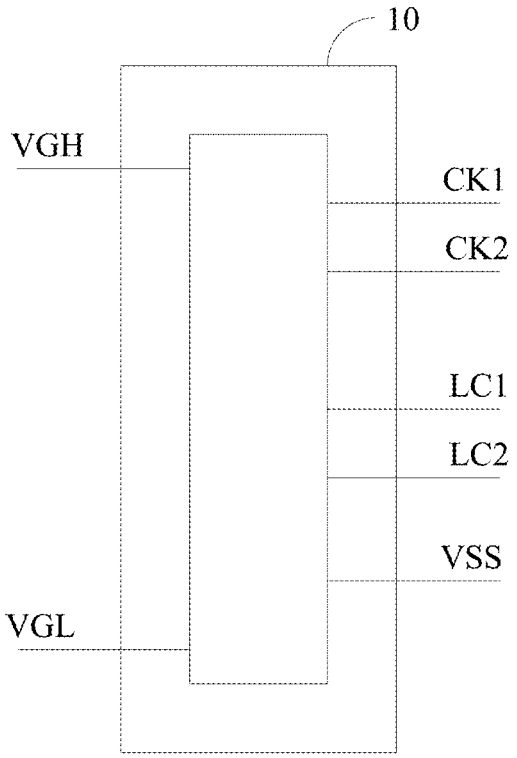
FIG 1 (PRIOR ART)
FIG. 1 is a circuit diagram of one conventional level transition circuit.
Figure 2:
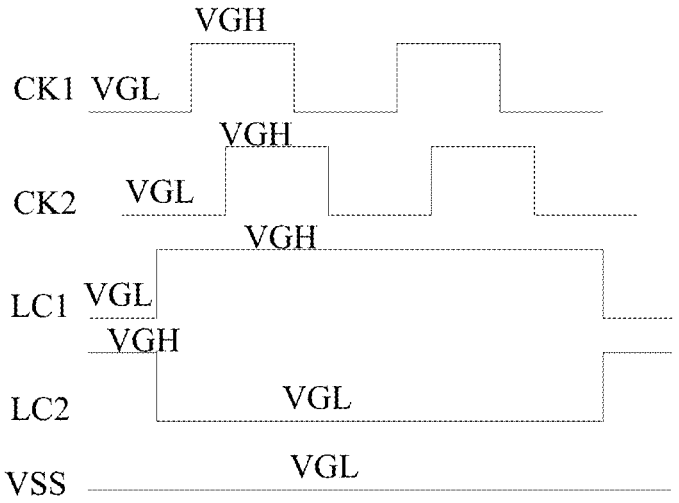
FIG 2 (PRIOR ART)
FIG. 2 is a timing diagram of the clock signals, selection signals, and voltage reference signals of FIG. 1.
Figure 3:
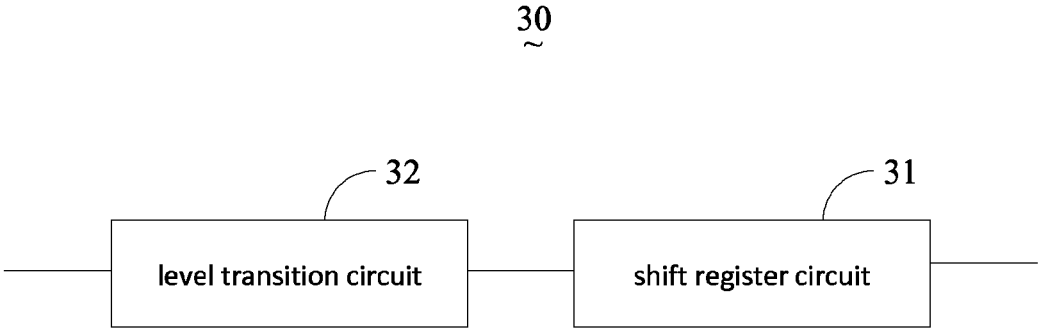
FIG. 3 is a block diagram of the gate driving circuit in accordance with a first embodiment.

FIG. 3 is a block diagram of the gate driving circuit in accordance with a first embodiment. The gate driving circuit may be adopted in LCD. As shown in FIG. 3, the gate driving circuit 30 includes a shift register circuit 31 and a level transition circuit 32 connected with the shift register circuit 31. The level transition circuit 32 generates the clock signals, the selection signals, and the negative voltage reference signals for the shift register circuit 31. The clock signals, the selection signals, and the negative voltage reference signals are configured for driving the shift register circuit 31.

Figure 4:
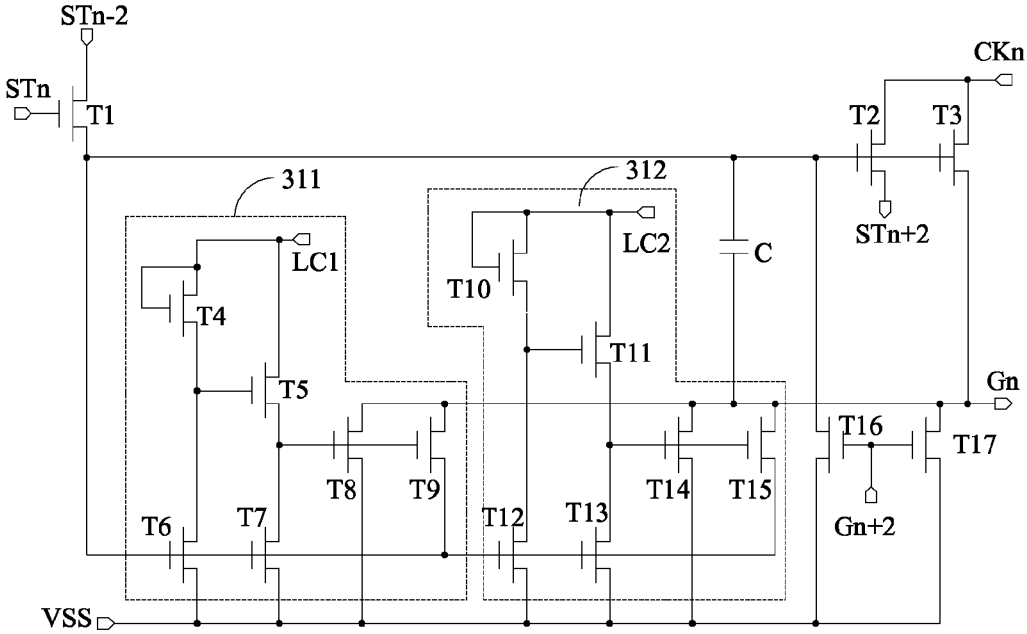
FIG. 4 is a circuit diagram of the shift register circuit of FIG. 3.

As shown in FIG. 4, the shift register circuit 31 drives the gate of the TFT of the LCD. The shift register circuit 31 includes a first TFT T1, a second TFT T2, a third TFT T3, a fourth TFT T4, a fifth TFT T5, a sixth TFT T6, a seventh TFT T7, an eighth TFT T8, a ninth TFT T9, a tenth TFT T10, a eleventh TFT T11, a twelfth TFT T12, a thirteenth TFT T13, a fourteenth TFT T14, a fifteenth TFT T15, a sixteenth TFT T16, a seventeenth TFT T17 and a capacitor C.

A first end of the first TFT T1 connects with the triggering signals Stn−2 two levels ahead, a second end of the first TFT T1 connects with the triggering signals Stn at current level, a third end of the first TFT T1 connects with second ends of the second TFT T2 and the third TFT T3, a first ends of the second TFT T2 and the third TFT T3 connects with the clock signals CKn, a third end of the second TFT T2 connects with the triggering signals Stn+2 at two levels behind, a third end of the third TFT T3 connects with an output end Gn, a first end and a second end of the fourth TFT T4 and a first send of the fifth TFT T5 connects with selection signals LC1, a third end of the fourth TFT T4 and a second end of the fifth TFT T5 connects with a first end of the sixth TFT T6, a third end of the fifth TFT T5 connects with a first end of the seventh TFT T7. A second end of the sixth TFT T6, a second end of the seventh TFT T7, a third end of the ninth TFT T9, a second end of the twelfth TFT T12, a second end of the thirteenth TFT T13 and a third end of the fifteenth TFT T15 connects with the third end of the first TFT T1. A third end of the sixth TFT T6, a third end of the seventh TFT T7, a third end of the eighth TFT T8, a third end of the twelfth TFT T12, a third end of the thirteenth TFT T13, a third end of the fourteenth TFT T14, a third end of the sixteenth TFT T16, and a third end of the seventeenth TFT T17 connects with the negative voltage reference signals (VSS). A first end of the eighth TFT T8, a first end of the ninth TFT T9, a first end of the fourteenth TFT T14, a first end of the fifteenth TFT T15, a first end of the seventeenth TFT T17 and one end of the capacitor C connects with the output end Gn. The other end of the capacitor C connects with the third end of the first TFT T1. Second ends of the eighth TFT T8 and the ninth TFT T9 connects with the third end of the fifth TFT T5. A first end and a second end of the tenth TFT T10 and a first end of the eleventh TFT T11 connects with the selection signals LC2. A third end of the tenth TFT T10 and a second end of the eleventh TFT T11 connect with a first end of the twelfth TFT T12. A third end of the eleventh TFT T11, a second end of the fourteenth TFT T14, a second end of the fifteenth TFT T15 connect with a first end of the thirteenth TFT T13. A first end of the sixteenth TFT T16 connects with a third end of the first TFT T1. A second end of the sixteenth TFT T16 and a second end of the y17 connects with the output end Gn+2 two levels behind.

When the triggering signals Stn and the clock signals CKn are at high level, the first TFT T1 is turned and the capacitor C is charged. Afterward, the second TFT T2 and the third TFT T3 are turned on. At this moment, the triggering signals Stn+2 two levels behind and the output end Gn are clock signals CKn. The triggering signals Stn+2 two levels behind trigger the output end Gn+2 of the shift register circuit 31 two levels behind to output signals. At this moment, the sixteenth TFT T16 is turned on, and the second TFT T2 and the third TFT T3 are turned off. The clock signals CKn outputs low level, the seventeenth TFT T17 is turned on, and the output end Gn transits to the low level.

The shift register circuit 31 includes a first functional module 311 and a second functional module 312. The first functional module 311 includes the fourth TFT T4, the fifth TFT T5, the sixth TFT T6, the seventh TFT T7, the eighth TFT T8, and the ninth TFT T9. The second functional module 312 includes the tenth TFT T10, the eleventh TFT T11, the twelfth TFT T12, the thirteenth TFT T13, the fourteenth TFT T14, and the fifteenth TFT T15. The selection signals LC1 are opposite to the selection signals LC2. The selection signals LC1 controls the first functional module 311, and the selection signals LC2 controls the second functional module 312. When the triggering signals Stn are at low level, the first TFT T1 is turned off, the sixth TFT T6, the seventh TFT T7, the twelfth TFT T12, and the thirteenth TFT T13 are turned off. When the selection signals LC1 are at high level and the selection signals LC2 are at low level, the fourth TFT T4, the fifth TFT T5, the eighth TFT T8, and the ninth TFT T9 are turned on, and one end (lower end) is grounded. The capacitor C is discharged and prepares to be charged. At the same time, the output end Gn is grounded to turn off the output end Gn completely. Alternatively, the selection signals LC2 are at high level and the selection signals LC1 are at low level. The tenth TFT T10, the eleventh TFT T11, the fourteenth TFT T14 and the fifteenth TFT T15 are turned on, and one end of the capacitor C is grounded. At the same time, the output end Gn is grounded. The selection signals LC1 and the selection signals LC2 are configured for selecting the two functional modules within the shift register circuit 31 to operate alternately. That is, the first functional module 311 and the second functional module 312 operate alternately to prevent the TFTs from being damaged due to working for a long time period.

In the embodiment, the negative voltage value of the negative voltage reference signals (VSS) is larger than the negative voltage value of one of the clock signals CKn or the selection signals LC1, LC2. The negative voltage value of the negative voltage reference signals (VSS) is the voltage value of the negative voltage reference signals (VSS). The negative voltage value of the clock signals CKn is the voltage value when the clock signals CKn are at low level. The negative voltage value of the selection signals LC1, LC2 is the voltage value of the selection signals LC1, LC2 when the selection signals LC1, LC2 are at low level. For instance, the voltage value of the negative voltage value is −3, the negative voltage value of the negative voltage reference signals (VSS) is −3. The voltage value of the clock signals CKn at low level is −3, and the negative voltage value of the clock signals CKn is −3.

Preferably, the negative voltage value of the negative voltage reference signals (VSS) is larger than the negative voltage values of the clock signals CKn and the selection signals LC1, LC2.

Figure 5:
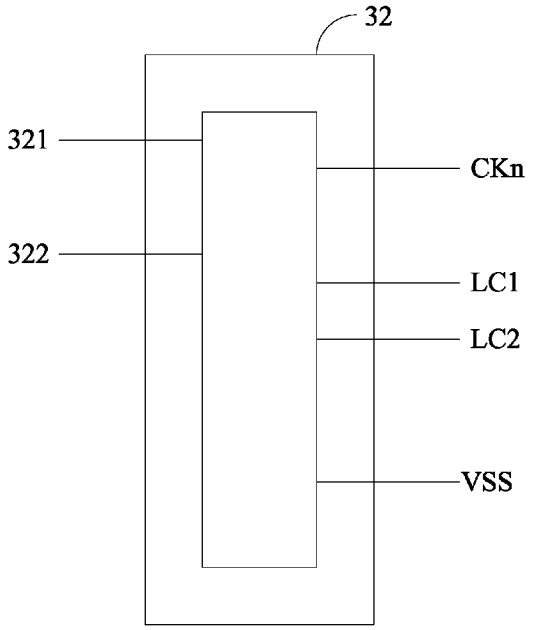
FIG. 5 is a circuit diagram of the level transition circuit of FIG. 3.

As shown in FIG. 5, the level transition circuit 32 includes two input ports 321, 322 for inputting negative voltage input signals. The negative voltage values of the negative voltage input signals inputted by the input ports 321, 322 are different. In addition, the level transition circuit 32 may generates the negative voltage value of the negative voltage reference signals (VSS) in accordance with the maximum value of the negative voltage values of the negative voltage input signals inputted by the at least two input ports 311, 322. For instance, the input port 321 inputs −3, and the input port 322 inputs −5. The level transition circuit 32 generates the negative voltage value of the negative voltage reference signals (VSS) in accordance with −3, and generates the negative voltage values of the clock signals CKn and the selection signals LC1, LC2 in accordance with −5. As such, the negative voltage values of the negative voltage reference signals (VSS), the clock signals CKn, and the selection signals LC1, LC2 are different.

In the embodiment, the level transition circuit 32 generates the negative voltage value of the negative voltage reference signals (VSS) in accordance with the maximum values of the negative voltage values of the negative voltage input signals inputted by the input ports 321, 322. As such, the negative voltage values of the negative voltage reference signals (VSS), the clock signals CKn, and the selection signals LC1, LC2 are different. With such configuration, the TFTs of the shift register circuit 31 may own a better turn-off capability so as to avoid malfunction.

Figure 6:
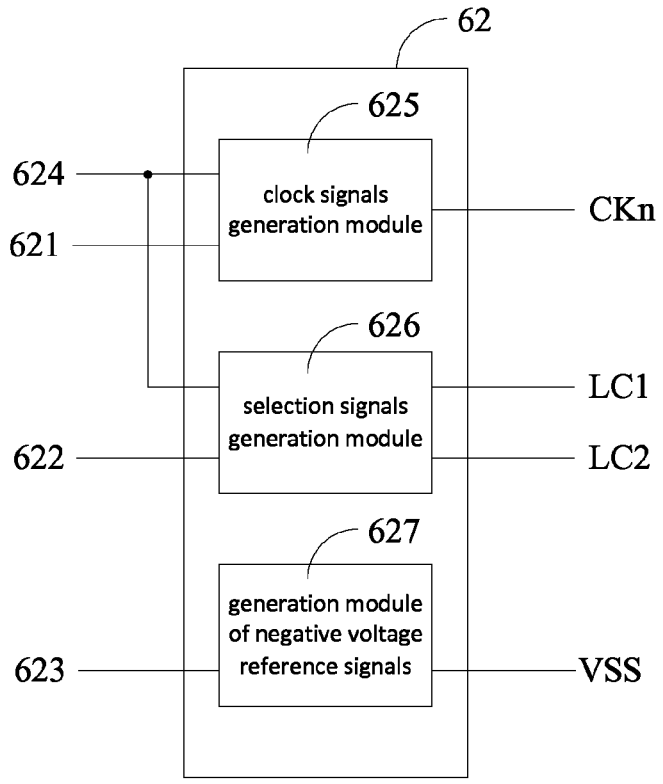
FIG. 6 is a circuit diagram of the level transition circuit in accordance with a second embodiment.

The second embodiment will be described on the basis of the gate driving circuit 30 in the first embodiment. The difference between the level transition circuit in the second embodiment and the first embodiment will be described hereinafter. As shown in FIG. 6, the level transition circuit 62 includes a first input port 621, a second input port 622, a third input port 623, a fourth input port 624, a clock signals generation module 625, a selection signals generation module 626, and a generation module of negative voltage reference signals 627.

The first input port 621 connects with the clock signals generation module 625 for inputting first negative voltage input signals. The second input port 622 connects with the selection signals generation module 626 for inputting the second negative voltage input signals. The third input port 623 connects with the generation module of negative voltage reference signals 627 for inputting the third negative voltage input signals. The clock signals generation module 625 configures the negative voltage value of the clock signals CKn to be proportional to the negative voltage value of the first negative voltage input signals. The selection signals generation module 626 configures the negative voltage values of the selection signals LC1, LC2 to be proportional to the negative voltage value of the second negative voltage input signals. The generation module of negative voltage reference signals 627 configures the negative voltage value of the negative voltage reference signals (VSS) to be proportional to the negative voltage value of the third negative voltage input signals when the third input port 623 includes the third negative voltage input signals. Preferably, the clock signals generation module 625 configures the negative voltage value of the clock signals CKn to be equal to the negative voltage value of the first negative voltage input signals. The selection signals generation module 626 configures the negative voltage value of the clock signals CKn to be the negative voltage value of the first negative voltage input signals. The selection signals generation module 626 configures the negative voltage value of the selection signals LC1, LC2 to be the negative voltage value of the second negative voltage input signals. The generation module of negative voltage reference signals 627 configures the negative voltage value of the negative voltage reference signals (VSS) to be the negative voltage value of the third negative voltage input signals when the generation module of negative voltage reference signals 627 includes the third negative voltage input signals.

The negative voltage value of the third negative voltage input signals is larger than one of the negative voltage values of the first negative voltage input signals and the second negative voltage input signals. Preferably, the negative voltage value of the third negative voltage input signals is larger than the negative voltage values of the first negative voltage input signals and the second negative voltage input signals. Thus, the negative voltage values of the negative voltage reference signals (VSS), the clock signals CKn, and the selection signals LC1, LC2 are different.

The fourth input port 624 is configured for inputting positive voltage input signals. The clock signals generation module 625 configures the positive voltage value of the clock signals CKn to be proportional to the positive voltage value of the positive voltage input signals. The selection signals generation module 626 configures the positive voltage values of the selection signals LC1, LC2 to be proportional to the positive voltage value of the positive voltage input signals. The positive voltage value of the clock signals CKn is the high level of the clock signals CKn. The positive voltage value of the selection signals LC1, LC2 is the high level of the selection signals LC1, LC2. Preferably, the clock signals generation module 625 configures the positive voltage value of the clock signals CKn to be the positive voltage value of the positive voltage input signals. The selection signals generation module 626 configures the positive voltage value of the selection signals LC1, LC2 to be the positive voltage value of the positive voltage input signals.

Figure 7:
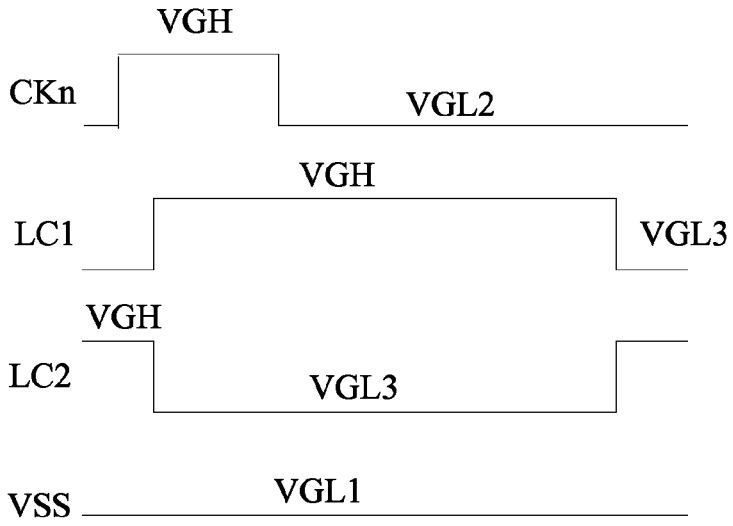
FIG. 7 is a timing diagram of the clock signals, the selection signals, and the negative voltage reference signals of FIG. 6.

FIG. 7 is a timing diagram of the clock signals, the selection signals, and the negative voltage reference signals of FIG. 6. The negative voltage value VGL1 of the negative voltage reference signals (VSS) is larger than the positive voltage value VGL2 of the CKn and the positive voltage value VGL3 of the selection signals LC1, LC2. The positive voltage value VGH of the clock signals CKn is the same with the positive voltage value VGH of the selection signals LC1, LC2.

In addition, the generation module of negative voltage reference signals 627 further configures the negative voltage value of the negative voltage reference signals (VSS) to be proportional to the maximum values of the negative voltage values of the first negative voltage input signals and the second negative voltage input signals when the third input port 623 does not include the third negative voltage input signals.

Figure 8:
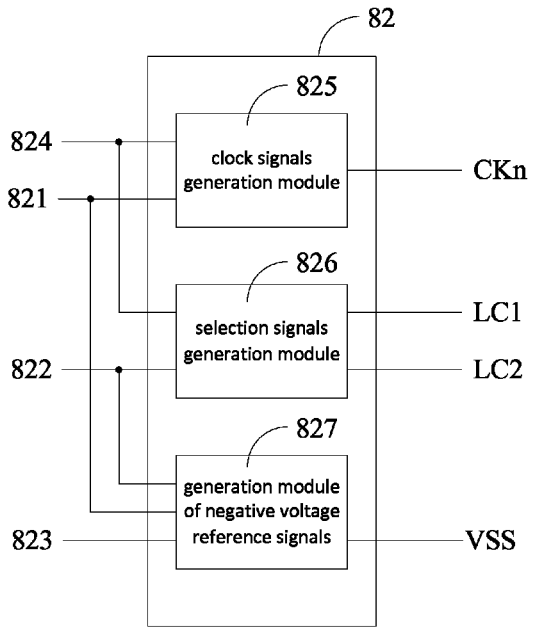
FIG. 8 is a circuit diagram of the level transition circuit in accordance with a third embodiment.

FIG. 8 is a circuit diagram of the level transition circuit in accordance with a third embodiment. The third embodiment will be described on the basis of the gate driving circuit 30 in the first embodiment. The level transition circuit 82 includes a first input port 821, a second input port 822, a third input port 823, a fourth input port 824, a clock signals generation module 825, a selection signals generation module 826, and a generation module of negative voltage reference signals 827, wherein the generation module of negative voltage reference signals 827 is a voltage comparator.

The first input port 821 connects respectively with the clock signals generation module 825 and the generation module of negative voltage reference signals 827 for inputting the first negative voltage input signals. The second input port 822 respectively connects with the selection signals generation module 826 and the generation module of negative voltage reference signals 827 for inputting the second negative voltage input signals. The third input port 823 connects with the generation module of negative voltage reference signals 827 for inputting the third negative voltage input signals. The generation module of negative voltage reference signals 827 compares the first negative voltage input signals, the second negative voltage input signals and the third negative voltage input signals to obtain the maximum value among the above input signals. Preferably, the clock signals generation module 825 configures the negative voltage value of the clock signals CKn to be equal to the negative voltage value of the negative voltage input signals. The selection signals generation module 826 configures the negative voltage value of the selection signals LC1, LC2 to be the negative voltage value of the second negative voltage input signals. The generation module of negative voltage reference signals 827 configures the negative voltage value of the selection signals LC1, LC2 to be equal to the negative voltage value of the second negative voltage input signals. The generation module of negative voltage reference signals 827 configures the negative voltage value of the negative voltage reference signals (VSS) to be equal to the maximum value of the first negative voltage input signals, the second negative voltage input signals and the third negative voltage input signals when the third input port 823 includes the third negative voltage input signals.

When the third negative voltage input signal is larger than the first negative voltage input signals and the second negative voltage input signals, that is, the negative voltage value of the third negative voltage input signals is larger than the negative voltage values of the first negative voltage input signals and the second negative voltage input signals, the generation module of negative voltage reference signals 827 configures the negative voltage value of the negative voltage reference signals (VSS) to be equal to the negative voltage value of the third negative voltage input signals.

The fourth input port 824 is configured for inputting the positive voltage input signals, wherein the clock signals generation module 825 configures the positive voltage value of the clock signals CKn to be proportional to the positive voltage value of the positive voltage input signals. The selection signals generation module 826 configures the positive voltage value of the selection signals LC1, LC2 to be proportional to the positive voltage value of the positive voltage input signals. The positive voltage value of the clock signals CKn is the high level of the clock signals CKn. The positive voltage value of the selection signals LC1, LC2 is the high level of selection signals LC1, LC2. Preferably, the clock signals generation module 825 configures the positive voltage value of the clock signals CKn to be equal to the positive voltage value of the positive voltage input signals. The selection signals generation module 826 configures the positive voltage value of the selection signals LC1, LC2 to be the positive voltage value of the positive voltage input signals.

Figure 9:
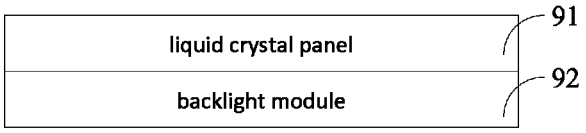
FIG. 9 is a schematic view of the LCD in accordance with a first embodiment.

FIG. 9 is a schematic view of the LCD in accordance with a first embodiment. The LCD includes a liquid crystal panel 91 and a backlight module 92. The liquid crystal panel 91 is arranged on the backlight module 92. The liquid crystal panel 91 includes the gate driving circuit for driving the gate of the TFTs of the liquid crystal panel 91. The gate driving circuit may be the gate driving circuit 30 in the above embodiments.

In view of the above, the level transition circuit generates the clock signals, the selection signals and the negative voltage reference signals for the shift register circuit. The clock signals, the selection signals and the negative voltage reference signals are for driving the shift register circuit, wherein the negative voltage reference signals are larger than negative pressure value of the clock signals or the selections signals. In this way, the TFTs of the shift register circuit owns better turn-off capability so as to avoid malfunction.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A gate driving circuit of LCDs, comprising:

a shift register circuit and a level transition circuit connected with the shift register circuit, the level transition circuit generates clock signals, selection signals, and negative voltage reference signals for the shift register circuit, the clock signals, the selection signals, and the negative voltage reference signals are configured for driving the shift register circuit, and a negative voltage value of the negative voltage reference signals VSS is larger than the negative voltage value of one of the clock signals or the selection signals;

wherein the level transition circuit comprises at least two input ports for inputting negative voltage input signals, negative voltage values of the negative voltage input signals inputted by the input ports are different, and the level transition circuit generates the negative voltage reference signals in accordance with a maximum value of the negative voltage values of the negative voltage input signals inputted by the at least two input ports.

2. The gate driving circuit as claimed in claim 1, wherein the negative voltage value of the negative voltage reference signals is larger than the negative voltage values of the clock signals or the selection signals.

3. The gate driving circuit as claimed in claim 1, wherein the level transition circuit comprises a first input port, a second input port, a third input port, the first input port, the second input port, and the third input port are configured for respectively inputting first, second, and third negative voltage input signals, the level transition circuit further comprises a clock signals generation sub-circuit connected to the first input port, a selection signals generation sub-circuit connected to the second input port, and a generation sub-circuit of negative voltage reference signals connected to the third input port, the clock signals generation sub-circuit configures the negative voltage value of the clock signals to be proportional to the negative voltage value of the first negative voltage input signals, the selection signals generation sub-circuit configures the negative voltage values of the selection signals to be proportional to the negative voltage value of the second negative voltage input signals, the generation sub-circuit of negative voltage reference signals configures the negative voltage value of the negative voltage reference signals to be proportional to the negative voltage value of the third negative voltage input signals when the third input port has the third negative voltage input signals.

4. The gate driving circuit as claimed in claim 3, wherein the negative voltage value of the third negative voltage input signals is larger than one of the negative voltage values of the first negative voltage input signals and the second negative voltage input signals.

5. The gate driving circuit as claimed in claim 4, wherein the negative voltage value of the third negative voltage input signals is larger than the negative voltage values of the first negative voltage input signals and the second negative voltage input signals.

6. The gate driving circuit as claimed in claim 5, wherein the generation sub-circuit of negative voltage reference signals further configures the negative voltage value of the negative voltage reference signals to be proportional to the maximum value of the negative voltage values of the first negative voltage input signals and the second negative voltage input signals when the third negative voltage input signals are not in the third input port.

7. The gate driving circuit as claimed in claim 5, wherein the level transition circuit further comprises a fourth input port configured for inputting positive voltage input signals, wherein the clock signals generation sub-circuit configures a positive voltage value of the clock signals to be proportional to the positive voltage value of the positive voltage input signals, and the selection signals generation sub-circuit configures the positive voltage values of the selection signals to be proportional to the positive voltage value of the positive voltage input signals.

8. The gate driving circuit as claimed in claim 1, wherein the selection signals and the selection signals are configured for selecting two functional modules within the shift register circuit to operate alternately, the shift register circuit comprises a plurality of TFTs, the clock signals and the selection signals are respectively applied to a gate of the TFT, and the negative voltage reference signals are respectively applied to a corresponding source of the TFT.

9. A liquid crystal device (LCD), comprising:

a gate driving circuit comprising a shift register circuit and a level transition circuit connected with the shift register circuit, the level transition circuit generates clock signals, selection signals, and negative voltage reference signals for the shift register circuit, the clock signals, the selection signals, and the negative voltage reference signals are configured for driving the shift register circuit, and a negative voltage value of the negative voltage reference signals VSS is larger than the negative voltage value of one of the clock signals or the selection signals; and wherein the level transition circuit comprises at least two input ports for inputting negative voltage input signals, the negative voltage values of the negative voltage input signals inputted by the input ports are different, and the level transition circuit generates the negative voltage reference signals in accordance with a maximum value of the negative voltage values of the negative voltage input signals inputted by the at least two input ports.

10. The LCD as claimed in claim 9, wherein the negative voltage value of the negative voltage reference signals is larger than the negative voltage value of the clock signals or the selection signals.

11. The LCD as claimed in claim 9, wherein the level transition circuit comprises a first input port, a second input port, a third input port, the first input port, the second input port, and the third input port are configured for respectively inputting the first, the second, and the third negative voltage input signals, the level transition circuit further comprises a clock signals generation sub-circuit connected to the first port, a selection signals generation sub-circuit connected to the second port, and a generation sub-circuit of negative voltage reference signals connected to the third input port, the clock signals generation sub-circuit configures the negative voltage value of the clock signals to be proportional to the negative voltage value of the first negative voltage input signals, the selection signals generation sub-circuit configures the negative voltage values of the selection signals to be proportional to the negative voltage value of the second negative voltage input signals, the generation sub-circuit of negative voltage reference signals configures the negative voltage value of the negative voltage reference signals to be proportional to the negative voltage value of the third negative voltage input signals when the third input port has the third negative voltage input signals.

12. The LCD as claimed in claim 11, wherein the negative voltage value of the third negative voltage input signals is larger than one of the negative voltage values of the first negative voltage input signals and the second negative voltage input signals.

13. The LCD as claimed in claim 12, wherein the negative voltage value of the third negative voltage input signals is larger than the negative voltage values of the first negative voltage input signals and the second negative voltage input signals.

14. The LCD as claimed in claim 13, wherein the generation sub-circuit of negative voltage reference signals further configures the negative voltage value of the negative voltage reference signals to be proportional to the maximum value of the negative voltage values of the first negative voltage input signals and the second negative voltage input signals when the third negative voltage input signals are not in the third input port.

15. The LCD as claimed in claim 13, wherein the level transition circuit further comprises a fourth input port configured for inputting positive voltage input signals, wherein the clock signals generation sub-circuit configures a positive voltage value of the clock signals to be proportional to the positive voltage value of the positive voltage input signals, and the selection signals generation sub-circuit configures the positive voltage values of the selection signals to be proportional to the positive voltage value of the positive voltage input signals.

16. The LCD as claimed in claim 9, wherein the selection signals and the selection signals are configured for selecting two functional modules within the shift register circuit to operate alternately, the shift register circuit comprises a plurality of TFTs, the clock signals and the selection signals are respectively applied to a gate of the TFT, and the negative voltage reference signals are respectively applied to a corresponding source of the TFT.

* * * * *